US010779629B2

(12) United States Patent
Honma

(10) Patent No.: US 10,779,629 B2
(45) Date of Patent: Sep. 22, 2020

(54) COSMETIC MATERIAL RECEPTACLE AND METHOD FOR MANUFACTURING COSMETIC MATERIAL RECEPTACLE

(71) Applicant: TOKIWA CORPORATION, Nakatsugawa-shi, Gifu (JP)

(72) Inventor: Natsumi Honma, Kawaguchi (JP)

(73) Assignee: TOKIWA CORPORATION, Nakatsugawa-Shi (JP)

( * ) Notice: Subject to any disclaimer, the term of this patent is extended or adjusted under 35 U.S.C. 154(b) by 679 days.

(21) Appl. No.: 15/437,518

(22) Filed: Feb. 21, 2017

(65) Prior Publication Data

US 2017/0251784 A1 Sep. 7, 2017

(30) Foreign Application Priority Data

Mar. 1, 2016 (JP) ..... 2016-039016

(51) Int. Cl.
*A45D 33/00* (2006.01)
*A45D 33/36* (2006.01)

(52) U.S. Cl.
CPC ..... *A45D 33/003* (2013.01); *A45D 33/36* (2013.01); *A45D 2033/001* (2013.01)

(58) Field of Classification Search
CPC ..... A45D 33/003; A45D 33/36; A45D 2033/001; A45D 33/006; A45D 33/34
USPC ..... 132/317
See application file for complete search history.

(56) References Cited

U.S. PATENT DOCUMENTS 824,296 A * 6/1906 Harris ..... B44D 3/125 206/15.3
851,443 A * 4/1907 Schmidt ..... B44D 3/125 206/15.3
1,626,992 A * 5/1927 Willk ..... A45D 33/36 401/117
1,658,542 A * 2/1928 Willk ..... A45D 33/34 401/185
1,774,904 A * 9/1930 Scully ..... A45D 33/003 222/174

(Continued)

FOREIGN PATENT DOCUMENTS

CN 20-2760464 U 3/2013
CN 10-4254263 A 12/2014

(Continued)

OTHER PUBLICATIONS

Search Report dated Feb. 19, 2020, issued in corresponding French application 1751608.

*Primary Examiner* — Nicholas D Lucchesi
(74) *Attorney, Agent, or Firm* — Bacon & Thomas, PLLC

(57) ABSTRACT

A holding portion formed in a three-dimensional shape and with a cosmetic material adhered thereto is stored in a bottomed tubular receptacle, a shaft body extending from the holding portion is made to enter a hole communicating with inside and outside in a receptacle bottom portion, and in a state in which a lower end surface is flush with an outer surface of the bottom portion or located inside the hole, the shaft body is mounted to the bottom portion. Thus, it is possible to allow the cosmetic material of the holding portion, which does not move in the receptacle, to easily adhere to the application body, without contaminating the hand since a user does not hold the holding portion.

14 Claims, 12 Drawing Sheets

(56) References Cited

U.S. PATENT DOCUMENTS

| | | | | | |
|---|---|---|---|---|---|
| 1,902,199 | A * | 3/1933 | Tourtois | A45D 33/003 | 206/459.5 |
| 2,404,485 | A * | 7/1946 | Gleisner | A45D 33/003 | 229/5.5 |
| 2,664,226 | A * | 12/1953 | Gaston | A45D 33/34 | 222/632 |
| 4,381,159 | A * | 4/1983 | Payne | A61B 5/1172 | 118/31.5 |
| 9,814,303 | B1 * | 11/2017 | Waitesmith | A46B 17/065 | |
| 2005/0022326 | A1 * | 2/2005 | Lee | A46B 5/02 | 15/106 |
| 2007/0017826 | A1 * | 1/2007 | Tate | A45D 33/003 | 206/15.3 |
| 2009/0056739 | A1 * | 3/2009 | Lou | A45D 33/02 | 132/306 |
| 2010/0270333 | A1 * | 10/2010 | Roh | A45D 33/02 | 222/167 |
| 2016/0113375 | A1 * | 4/2016 | Lim | A45D 33/36 | 401/118 |
| 2018/0042360 | A1 * | 2/2018 | Gibson | A45D 33/006 | |

FOREIGN PATENT DOCUMENTS

| | | | |
|---|---|---|---|
| CN | 104665212 | A | 6/2015 |
| JP | S61-151833 | U | 9/1986 |
| JP | S 62 175718 | U | 11/1987 |
| JP | H-07265123 | A | 10/1995 |
| JP | H08-238885 | A | 9/1996 |
| JP | 2015-062636 | A | 4/2015 |
| JP | 2015 100552 | A | 6/2015 |
| WO | 2012/157643 | A1 | 11/2012 |

* cited by examiner

COSMETIC MATERIAL RECEPTACLE AND METHOD FOR MANUFACTURING COSMETIC MATERIAL RECEPTACLE

TECHNICAL FIELD

The present invention relates to a cosmetic material receptacle and a method for manufacturing a cosmetic material receptacle.

BACKGROUND ART

Conventionally, a cosmetic material holding body has been known in which a sheet-like base material is three-dimensionally molded, and a cosmetic material is held on the surface of the three-dimensional molded article (see, for example, Patent Document 1). When makeup is performed using such a cosmetic material holding body, generally, the cosmetic material held on the cosmetic material holding body is attached to, for example, a puff or the like and applied to the skin or the like.

CITATION LIST

Patent Document

Patent Document 1: WO 2012/157643 A

DISCLOSURE OF THE INVENTION

Problem to be Solved by the Invention

Here, at the time of carrying the cosmetic material holding body or when not in use of the cosmetic material holding body, since the cosmetic material holding body described in Patent Document 1 comes into contact with objects other than a portion to be applied and the objects are contaminated due to adherence of the cosmetic material, it is desired to store the cosmetic material holding body in a special receptacle. However, when the cosmetic material holding body is merely stored in the receptacle, in a case where a user causes the cosmetic material from the cosmetic material holding body in the receptacle to adhere, for example, to an application body such as a puff, there is a problem of difficulty in taking the cosmetic material due to the movement of the cosmetic material holding body. Meanwhile, if the user holds the cosmetic material holding body by hand so that the cosmetic material holding body does not move inside the receptacle, there is a problem of contamination of the cosmetic material due to adherence to the hands.

In view of the above, an object of the invention is to provide a cosmetic material receptacle, in which a cosmetic material holding portion formed in a three-dimensional shape and having a surface to which a cosmetic material adheres is stored and which allows the cosmetic material to easily adhere to an application body without contaminating the user's hand, and a method for manufacturing the cosmetic material receptacle.

Means for Solving Problem

A cosmetic material receptacle according to the invention is a cosmetic material receptacle having a cosmetic material holding portion which is formed in a three-dimensional shape and has a surface to which a cosmetic material adheres, the cosmetic material receptacle including: a bottomed tubular receptacle which stores the cosmetic material holding portion; a hole which is provided at a bottom portion of the receptacle and communicates with the inside and outside of the receptacle; and a shaft body which extends from the cosmetic material holding portion and is mounted to the bottom portion in a state in which a lower end portion thereof enters the hole, wherein a lower end surface of the shaft body is flush with an outer surface of the bottom portion or located inside the hole.

According to such a cosmetic material receptacle, there is provided a configuration in which the cosmetic material holding portion formed in a three-dimensional shape and having a surface to which the cosmetic material adheres is stored in the bottomed tubular receptacle, the shaft body extending from the cosmetic material holding portion enters a hole provided at the bottom portion of the receptacle and communicating the inside and outside of the receptacle, and the shaft body is mounted to the bottom portion in a state in which its lower end surface is flush with the outer surface of the bottom portion or located inside the hole. Accordingly, it is possible to allow the cosmetic material of the cosmetic material holding portion, which does not move in the receptacle, to easily adhere to the application body, without contaminating the hand since a user does not hold the cosmetic material holding portion. Further, with the above configuration, in manufacturing of the cosmetic material receptacle, it is possible to adopt the procedures of gripping the shaft body while providing the shaft body as a long shaft body to enter the hole of the bottom portion, gripping and pulling a portion, which protrudes outward from the bottom portion through the hole, in the long shaft body, mounting a portion, which is located in the hole, of the long shaft body to the bottom portion, and cutting the long shaft body in the intermediate portion to provide the long shaft body as the shaft body such that the lower end surface of the long shaft body is flush with the outer surface of the bottom portion or is located inside the hole. Thus, the cosmetic material receptacle having the aforementioned configuration can be easily manufactured, while preventing the peeling of the cosmetic material, without touching the cosmetic material holding portion at the time of manufacturing.

Here, it is preferable that the lower end surface of the shaft body be thinner than a mounting shaft portion located in the hole above the lower end surface. When adopting such a configuration, it is possible to easily cut the shaft body with a thin portion as a boundary in manufacturing.

Further, the lower end surface of the shaft body may be exposed to the outside. When adopting such a constitution, in manufacturing, there is no need for a hole filling process after cutting the shaft body, and the receptacle can be more easily manufactured.

Further, the cosmetic material receptacle may further include a shielding portion which makes the lower end surface of the shaft body invisible from the outer surface side of the bottom portion. When adopting such a configuration, since the shielding portion makes the shaft body and the hole invisible from the outside, the appearance can be improved.

Further, when cross sections of the hole and the shaft body have a non-circular shape, the shaft body can be reliably mounted to the bottom portion so as not to rotate.

Further, when an upper clamping portion and a lower clamping portion, which clamp the cosmetic material holding portion from above and below and mount the cosmetic material holding portion to the shaft body, are included, it is possible to easily provide a configuration in which the shaft body extends from the cosmetic material holding portion.

Further, a method for manufacturing a cosmetic material receptacle according to the invention is a method for manufacturing the cosmetic material receptacle, the method including: gripping a shaft body having a long length to cause the long shaft body to enter the hole of the bottom portion; gripping and pulling a portion, which protrudes outward from the bottom portion through the hole, in the long shaft body, and mounting a portion, which is located inside the hole, in the long shaft body to the bottom portion; and cutting the long shaft body in an intermediate portion and providing the long shaft body as a shaft body such that the lower end surface of the long shaft body is flush with the outer surface of the bottom portion or is located inside the hole.

According to such a method for manufacturing the cosmetic material receptacle, the cosmetic material receptacle having the aforementioned configuration can be easily manufactured, while preventing the peeling of the cosmetic material, without touching the cosmetic material holding portion at the time of manufacturing.

Further, when the long shaft body is cut with a thin portion provided at the middle of the long shaft body as a boundary, cutting can be easily performed.

Effect of the Invention

As described above, according to the invention, it is possible to provide a cosmetic material receptacle which allows the cosmetic material to easily adhere to the application body, without contaminating the hand of the user, and additionally, can be easily manufactured, while preventing the cosmetic material from being peeled off without touching the cosmetic material holding portion at the time of manufacturing, and a method for manufacturing the cosmetic material receptacle.

MODE(S) FOR CARRYING OUT THE INVENTION

Figure 1:
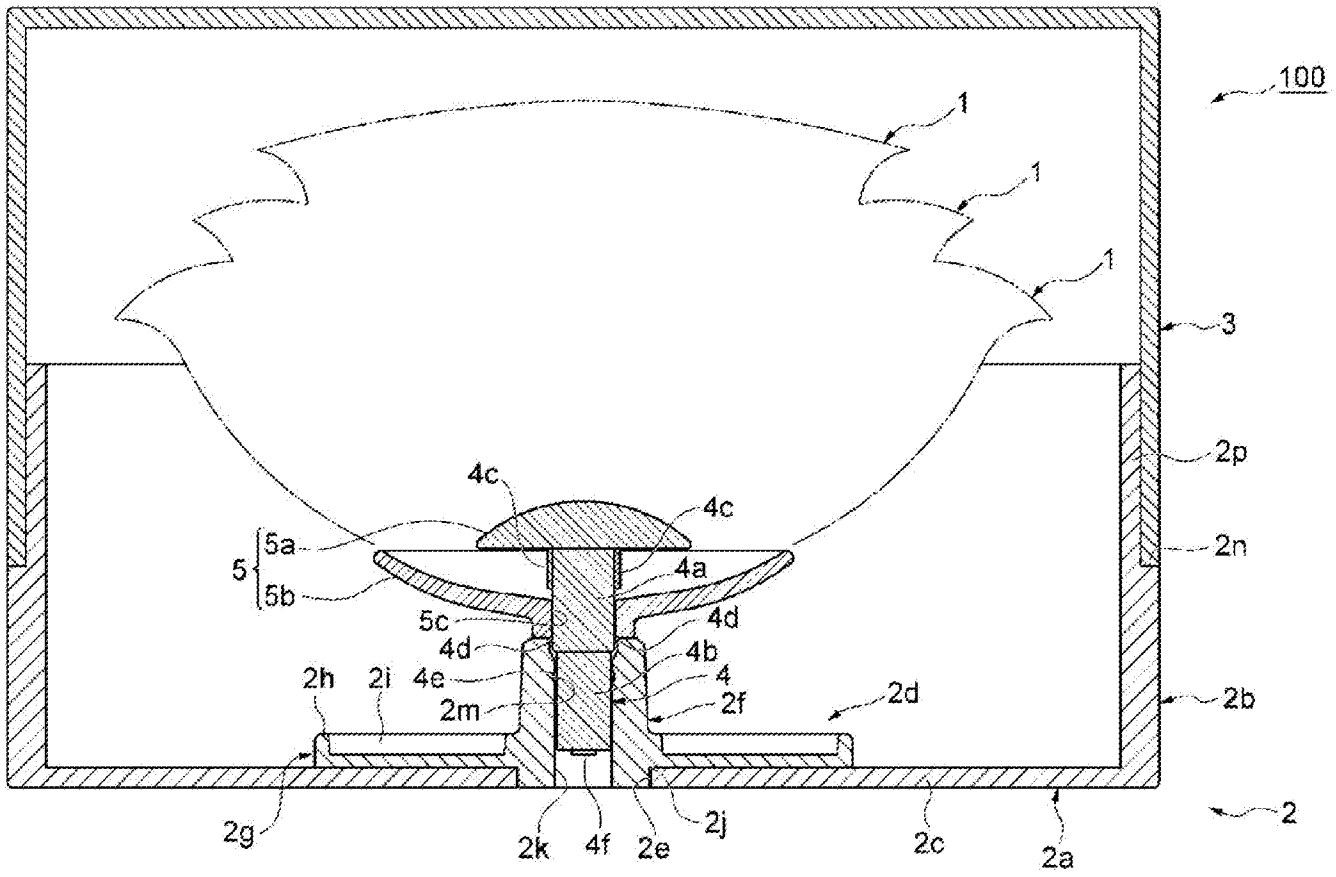
FIG. 1 is a longitudinal sectional view illustrating a cosmetic material receptacle according to an embodiment of the invention.
Figure 2:
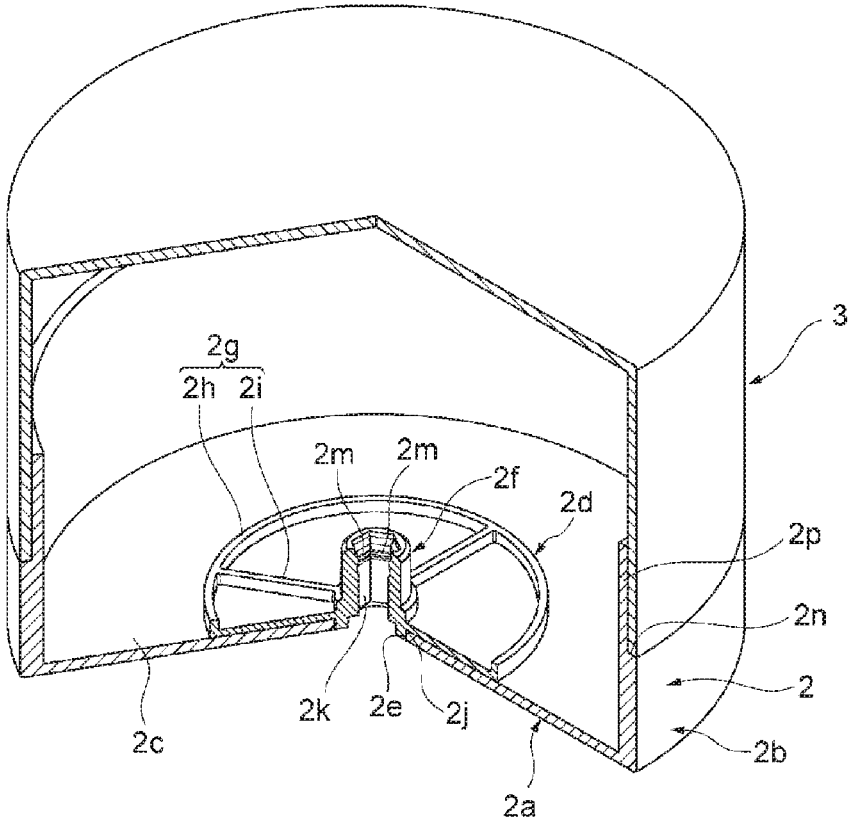
FIG. 2 is a broken perspective view illustrating a receptacle and a cap in FIG. 1.
Figure 3:
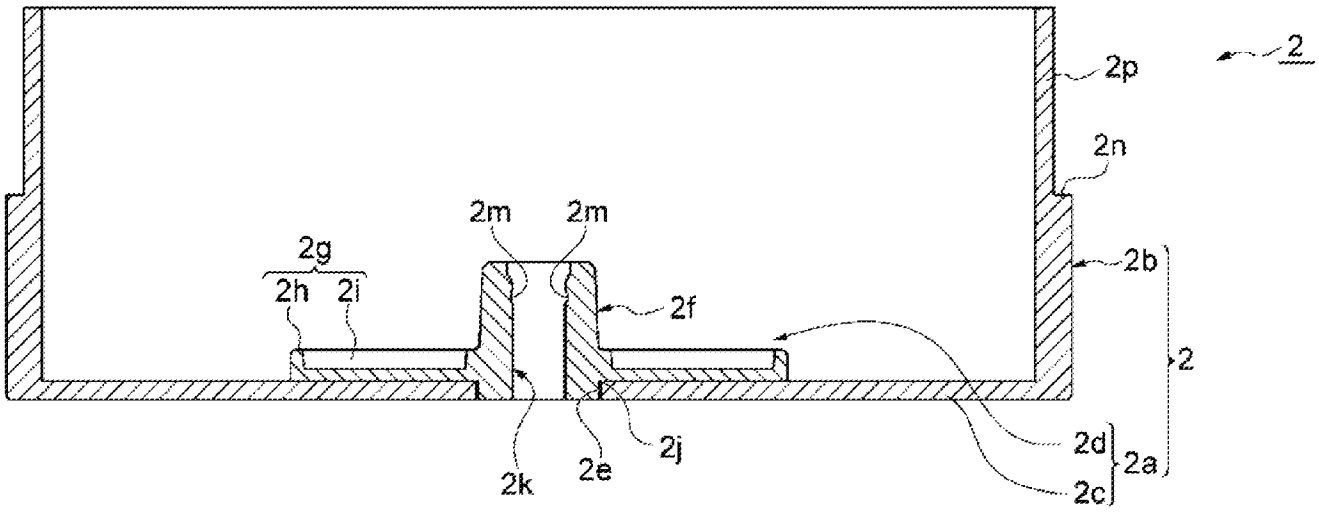
FIG. 3 is a longitudinal sectional view illustrating the receptacle in FIGS. 1 and 2.
Figure 4:
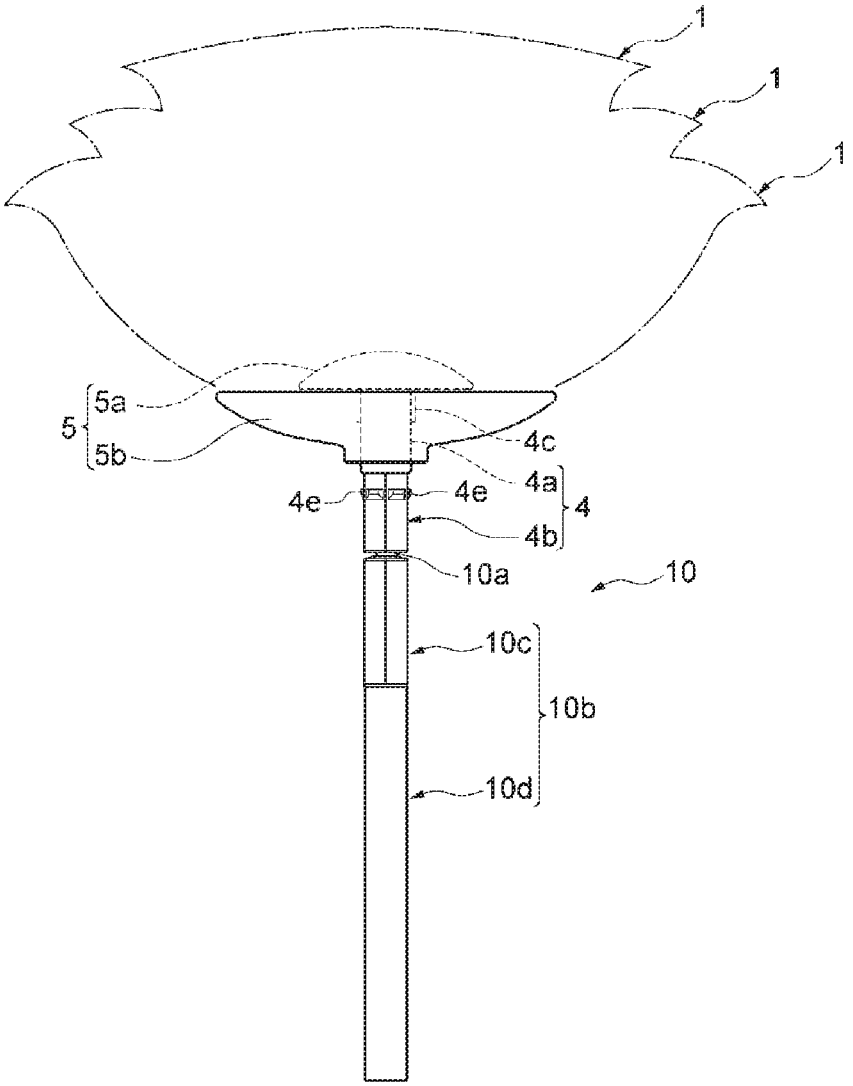
FIG. 4 is a front view illustrating a state before a cosmetic material holding portion and a shaft body in FIG. 1 are mounted to the receptacle, in which the original shape of the shaft body is a long shaft body.
Figure 5:
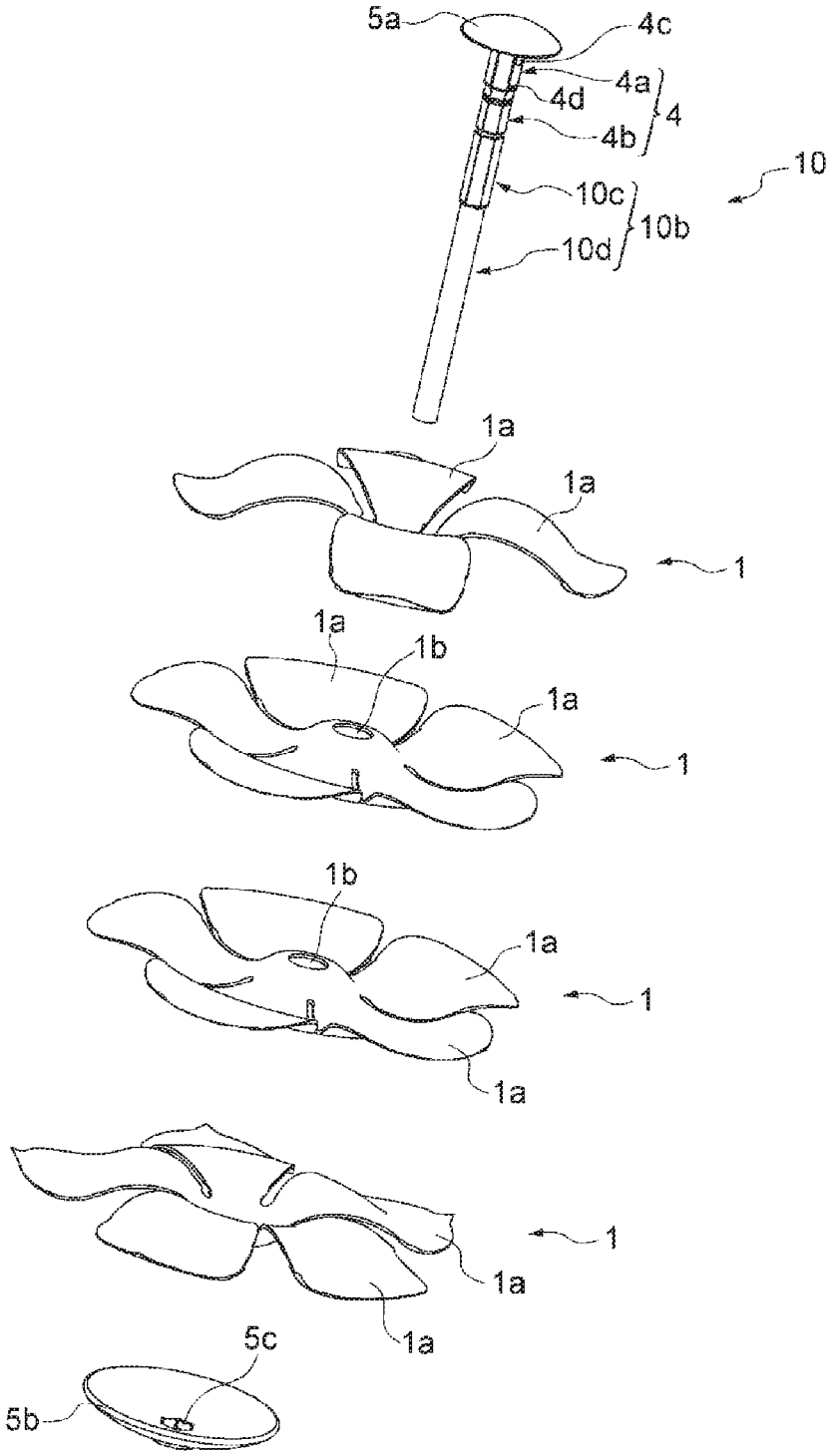
FIG. 5 is an exploded perspective view of FIG. 4.
Figure 6:
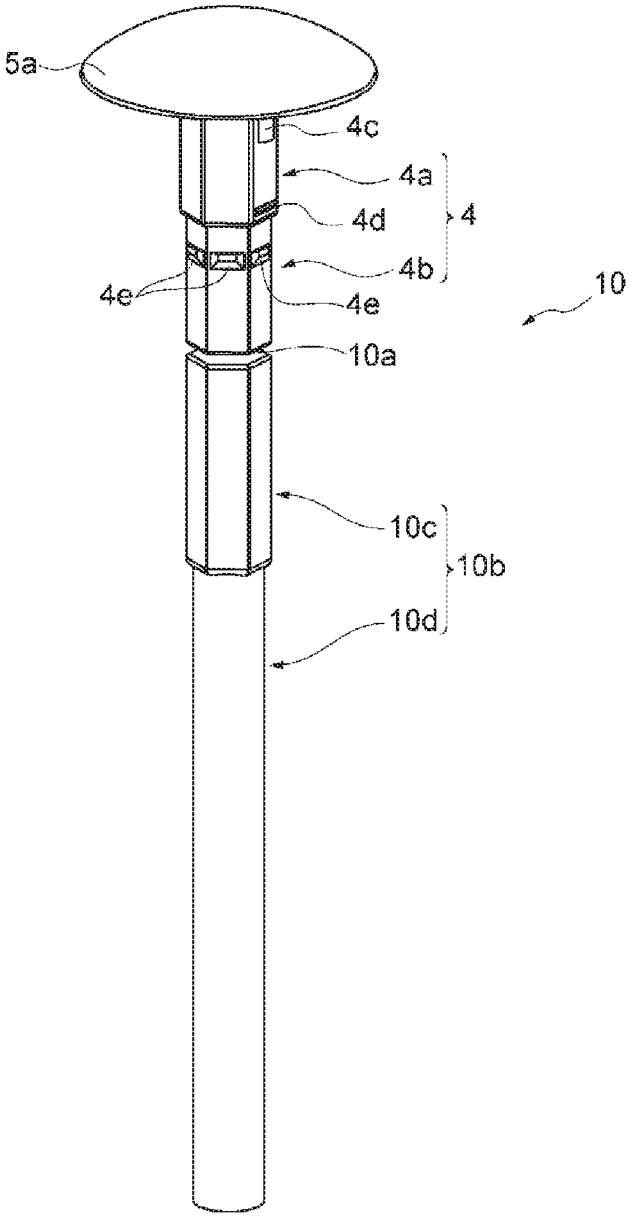
FIG. 6 is an enlarged perspective view of the long shaft body in FIG. 5.

Preferred embodiments of a cosmetic material receptacle and a method for manufacturing a cosmetic material receptacle according to the invention will be described below with reference to FIGS. 1 to 12. FIG. 1 is a longitudinal sectional view illustrating a cosmetic material receptacle according to an embodiment of the invention. FIG. 2 is a broken perspective view illustrating a receptacle and a cap. FIG. 3 is a longitudinal sectional view illustrating the receptacle. FIG. 4 is a front view illustrating a state before a cosmetic material holding portion and a shaft body are mounted to the receptacle, in which the original shape of the shaft body is a long shaft body. FIG. 5 is an exploded perspective view of FIG. 4. FIG. 6 is an enlarged perspective view of the long shaft body in FIG. 5. FIGS. 7 to 11 are diagrams for describing a method for manufacturing the cosmetic material receptacle. FIG. 12 is a diagram illustrating a state in which the long shaft body is shortened to a shaft body by the manufacturing method for FIGS. 7 to 11. In each drawing, the same constituent elements are denoted by the same reference numerals.

The cosmetic material receptacle of this embodiment stores a three-dimensional object rich in decorative properties in a receptacle, and enables a user to appropriately use a cosmetic material which adheres to the surface of the three-dimensional object for makeup.

As illustrated in FIG. 1, a cosmetic material receptacle 100 includes a cosmetic material holding portion 1 which is a three-dimensional object and has a surface to which a cosmetic material adheres, a receptacle 2 which stores the cosmetic material holding portion 1, and a cap 3 serving as a lid of the receptacle 2, a shaft body 4 which extends from the cosmetic material holding portion 1 and is mounted on the receptacle 2, and a mounting portion 5 which mounts the cosmetic material holding portion 1 on the shaft body 4.

As illustrated in FIGS. 1 to 3, the whole receptacle 2 is formed of paper except a shaft body holder portion 2*d* to be described later, and is configured in a bottomed cylindrical shape which includes a disk-like bottom portion 2*a* having a convex portion at the center, and a cylindrical tubular portion 2*b* standing from an outer circumferential portion of the bottom portion 2*a*.

The bottom portion 2*a* includes a disk-shaped base portion 2*c*, and the shaft body holder portion 2*d* standing at the central portion of the base portion 2*c*. The base portion 2*c* has a through-hole 2*e* for attaching the shaft body holder portion 2*d* at the center.

The shaft body holder portion 2*d* is formed, for example, of a resin such as PP, and has a disk-shaped flange portion 2*g* formed at a substantially central portion in the axial direction of a shaft portion 2*f* formed in a cylindrical shape.

The flange portion 2*g* is a portion for being attached to the base portion 2*c*, has a convex portion 2*h* protruding upward in an annular shape on the outer circumferential portion, and has a reinforcing rib 2*i* extending radially from the shaft portion 2*f* and connected to the convex portion 2*h* on its upper surface. A lower portion 2*j* below the flange portion 2*g* of the shaft portion 2*f* is a portion which is fitted into the through-hole 2*e* of the base portion 2*c*. A tubular hole 2*k* penetrating through the shaft portion 2*f* is intended to allow the shaft body 4 to enter, and is formed in a hexagonal shape. An upper portion of the hole 2*k* is enlarged in diameter so that a lower stopper 4*d*, which will be described later, of the shaft body 4 can enter, and a fitting concave portion 2*m* for fitting the shaft body 4 is annularly formed so as to be continuous to each surface of the hexagonal shape in the circumferential direction, at a position which is slightly lower than the enlarged diameter portion.

Further, in a state in which the lower portion 2*j* of the shaft body holder portion 2*d* below the flange portion 2*g* is inserted into the through-hole 2*e* of the base portion 2*c*, the bottom surface of the flange portion 2*g* is fixed to the base portion 2*c*, for example, by a double-sided tape or an adhesive. The lower end surface of the lower portion 2*j* of the shaft body holder portion 2*d* is flush with the outer surface (bottom surface) of the base portion 2*c*.

Here, the reason why the hole 2*k* for communication with the inside and the outside is provided in the bottom portion 2*a* will be described in detail later. However, by passing through the long shaft body 10 (see FIG. 6) which is the original shape of the shaft body 4, it is possible to simply manufacture the cosmetic material receptacle 100 of FIG. 1.

The cylindrical tubular portion 2*b* has a protruding portion 2*p* in which an upper outer circumferential surface has an outer diameter smaller than the outer circumferential surface of the lower portion via an annular stepped surface 2*n*. The protruding portion 2*p* is intended to fit the cap 3.

The cap 3 is formed of paper, and as illustrated in FIGS. 1 and 2, is formed into a bottomed cylindrical shape, and its end portion on the open end side serves as a fitting portion that is fitted to the protruding portion 2*p* of the tubular portion 2*b* of the receptacle 2.

Further, by gripping the cap 3 and pushing (externally inserting) the cap 3 to the protruding portion 2*p* of the receptacle 2 with an appropriate force, the lower end surface of the cap 3 abuts against the stepped surface 2*n* of the tubular portion 2*b*, and thus the cap 3 is mounted to the receptacle 2. Meanwhile, by pulling the cap 3 from the receptacle 2 with an appropriate force, the cap 3 is detached from the receptacle 2.

Here, although the receptacle 2 and the cap 3 are formed in the bottomed cylindrical shape in this case, they may have a bottomed square tubular shape. In this case, the receptacle 2 and the cap 3 except the shaft body holder portion 2*d* are made of paper without a need for a metal mold so as to easily cope with various sizes. However, for example, the receptacle 2 and the cap 3 may be molded from resin, glass, rubber or the like. If the metal mold is used, it is possible to integrally mold the base portion 2*c*, the shaft body holder portion 2*d*, and the tubular portion 2*b* of the receptacle 2.

As illustrated in FIG. 1, the cosmetic material holding portion 1 is formed in a three-dimensional shape, and a cosmetic material adheres to the surface thereof. Here, as illustrated in FIG. 5, the cosmetic material holding portion 1 is, for example, a flower (corolla)-shaped artificial flower such as a rose having a plurality of petals (flower petals) 1*a*, and a plurality (four in this case) of artificial flowers is superimposed in the axial direction, and is provided by allowing the cosmetic material to adhere to its surface. In this case, in particular although the shapes of the plurality of artificial flowers 1 are preferably different, the artificial flowers 1 may have all the same shape, or one artificial flower 1 may be used. Further, a through-hole 1*b* for allowing the passage of the shaft body 4 is provided at the center of the artificial flower 1.

Next, the shaft body 4 illustrated in FIG. 1 will be described. However, the original shape of the shaft body 4 before being mounted to the receptacle 2 is the long shaft body 10 illustrated in FIG. 6, and will also be illustrated with reference to FIG. 6, while considering the ease of understanding. Here, the shaft body 4 is formed, for example, of a resin such as PP, and thus, the long shaft body 10 having the original shape is also made of resin. As illustrated in FIGS. 1 and 6, the shaft body 4 has a short shaft body shape, and a large-diameter head portion connected to the upper portion of the shaft body 4 serves as an upper clamping portion 5*a* which forms one of the mounting portion 5. The upper clamping portion 5*a* is formed integrally with the shaft body 4 and made of resin.

The shaft body 4 has a hexagonal cross-sectional shape similarly to the hole 2*k* of the shaft body holder portion 2*d* of the bottom portion 2*a*. The shaft body 4 includes an attaching shaft portion 4*a* extending downward from the upper clamping portion 5*a* to attach the artificial flower 1, and a mounting shaft portion 4*b* extending downward from the attaching shaft portion 4*a* for being mounted to the shaft body holder portion 2*d*.

A convex upper stopper 4*c* is provided at an upper portion of a partial surface (here, two opposing surfaces) of the outer circumferential surface of the attaching shaft portion 4*a* having a hexagonal shape, and a convex lower stopper 4*d* is provided at a lower portion of a partial surface of the outer circumferential surfaces of the attaching shaft portion 4*a*.

The mounting shaft portion 4*b* is slightly smaller than the attaching shaft portion 4*a* with a similar shape, and on each surface of the hexagonal outer circumferential surface, a fitting convex portion 4*e* for being fitted to the fitting concave portion 2*m* of the shaft body holder portion 2*d* is provided.

Further, in this embodiment, as illustrated in FIG. 1, a lower clamping portion 5*b* is provided which constitutes the other side of the mounting portion 5 and cooperates with the upper clamping portion 5*a* to mount the artificial flower 1 to the shaft body 4. The lower clamping portion 5*b* is formed, for example, of a resin such as PP, and has a dish shape. A through-hole 5*c* having a hexagonal cross section through which the shaft body 4 passes is provided at the center of the lower clamping portion 5*b* (see FIG. 5).

Further, in a state in which the shaft body 4 passes through the through-holes 1*b* of the plurality of artificial flowers 1 superimposed in the axial direction and the through-hole 5*c* of the lower clamping portion 5*b* (see FIG. 5), the plurality of artificial flowers 1 is clamped between the upper clamping portion 5*a* and the lower clamping portion 5*b*. More specifically, the lower clamping portion 5*b* is loosely fitted to the shaft body 4 at a position climbing over the lower stopper 4*d* (see FIG. 6) of the shaft body 4 upward, and the lower clamping portion 5*b* is in a state of not being detached downward by the lower stopper 4*d*. In this state, the plurality of artificial flowers 1 is in a state of being mounted to the shaft body 4. Further, the upper stopper 4*c* is intended to prevent the plurality of artificial flowers 1 and the lower clamping portion 5*b* from going too far upward and the shape of the artificial flower 1 from collapsing.

The shaft body 4 on which the artificial flower 1 is mounted is inserted into the hole 2*k* of the shaft body holder portion 2*d* of the bottom portion 2*a*, and in a state in which the lower end surface of the lower clamping portion 5*b* abuts against the upper end surface of the shaft portion 2*f* of the shaft body holder portion 2*d*, when the fitting convex portion 4*e* of the mounting shaft portion 4*b* of the shaft body 4 is fitted to the fitting concave portion 2*m* of the shaft body holder portion 2*d*, the shaft body 4 is mounted to the bottom portion 2*a*. Here, since the hole 2*k* and the shaft body 4 (mounting shaft portion 4*b*) have a hexagonal shape, the shaft body 4 is reliably mounted so as not to rotate.

In this state, the lower end surface 4*f* of the shaft body 4 is in a state of being located in the hole 2*k* and exposed outward through the hole 2*k*. Further, the lower end surface 4*f* of the shaft body 4 is configured to be thinner (smaller; smaller in diameter) than the portion located in the hole 2*k* above the lower end surface 4*f*, that is, the mounting shaft portion 4*b* of the shaft body 4. The reason for such a thin configuration will be described later in detail. However, the reason is that, when the cosmetic material receptacle 100 is manufactured, the long shaft body 10 is cut with a thinned portion (hereinafter, simply referred to as a thin portion) 10*a* of the long shaft body 10 illustrated in FIG. 4 as a boundary and the thin portion remains as a cut trace.

Here, although the lower end surface 4*f* of the shaft body 4 is located in the hole 2*k*, the lower end surface 4*f* may be flush with the outer surface of the bottom portion 2*a*.

Incidentally, here, the shaft body 4 may be mounted to the shaft body holder portion 2*d* by fitting, but a portion, which is located inside the hole 2*k*, of the shaft body 4 may be mounted to the shaft body holder portion 2*d*, for example, by adhesion or the like.

When performing the makeup using the cosmetic material receptacle 100 as illustrated in FIG. 1 configured as described above, the cap 3 is removed, and the cosmetic material of the artificial flower 1 may be allowed to adhere to the application body, for example, using the application body such as a puff or a brush, or may be applied to skin or the like.

Next, a method for manufacturing the artificial flower 1 will be described with reference to FIG. 5. Here, the artificial flower 1 is formed, for example, by pressing a sheet such as a woven fabric or cloth molded by a resin fiber such as polyester, and is formed so as to have a plurality of petals 1*a*. Specifically, the artificial flower 1 is formed by heating the sheet and performing the press machining with a metal mold. In this state, the cosmetic material has not yet adhered to the artificial flower 1.

Next, a method for mounting such an artificial flower 1 to the shaft body 4 will be described. Before being mounted to the receptacle 2, the shaft body 4 is the long shaft body 10 illustrated in FIG. 6 as described above. The long shaft body 10 has an extending portion 10*b* extending further downward via the aforementioned thin portion 10*a*, at the lower end of the shaft body 4. The extending portion 10*b* has a first extending portion 10*c* which extends downward from the thin portion 10*a* and has a hexagonal cross section similar to the mounting shaft portion 4*b* of the shaft body 4, and a long columnar second extending portion 10*d* which extends further downward from the first extending portion 10*c*. The size of the columnar second extending portion 10*d* is a size (outer diameter) that can easily pass through the hole 2*k* of the bottom portion 2*a*.

Further, as illustrated in FIG. 5, when the artificial flower 1 and the lower clamping portion 5*b* are superimposed with each other such that the extending portion 10*b* of the long shaft body 10 and the shaft body 4 pass through the through-holes 1*b* of the plurality of artificial flowers 1 and the through-hole 5*c* of the lower clamping portion 5*b*, the lower clamping portion 5*b* climbs over the lower stopper 4*d*, and thus, the plurality of artificial flowers 1 and the lower clamping portion 5*b* are mounted to the long shaft body 10 (see FIG. 4). Thereafter, the fine shape of the petal 1*a* and the like is formed by hand finishing.

Then, the cosmetic material adheres to the artificial flowers 1 thus superimposed. The cosmetic material is, for example, a cosmetic material of powder, gel, cream, oil types, and the like, and can be used as a face powder, a body powder, a cheek color, an eye color, a lip color and the like.

As a method for causing the cosmetic adhere to the artificial flower 1, specifically, it is possible to use various methods such as a method for immersing the artificial flower 1 into a slurry-type cosmetic material in the state of holding and inverting the extending portion 10*b* of the long shaft body 10 illustrated in FIG. 4, or a method for spraying the cosmetic material with a spray from the periphery of the artificial flower 1 to adhere.

In this way, a plurality of artificial flowers 1 to which the cosmetic material adheres is obtained.

Next, with reference to FIGS. 7 to 11, a method for mounting the shaft body 4 extending from the artificial flower 1 to the receptacle 2 will be described.

Figure 7:
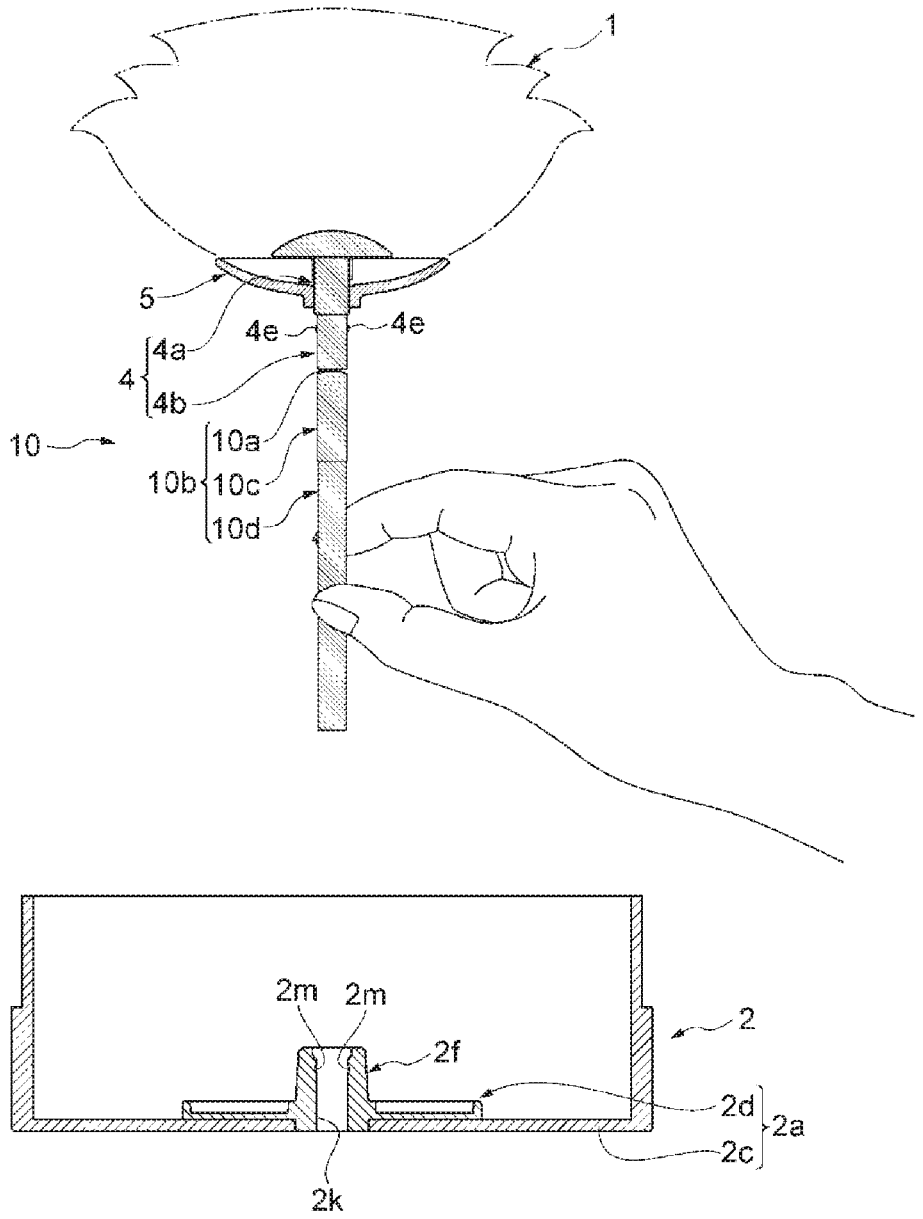
FIG. 7 is a diagram for describing a method for manufacturing the cosmetic material receptacle illustrated in FIG. 1.
Figure 8:
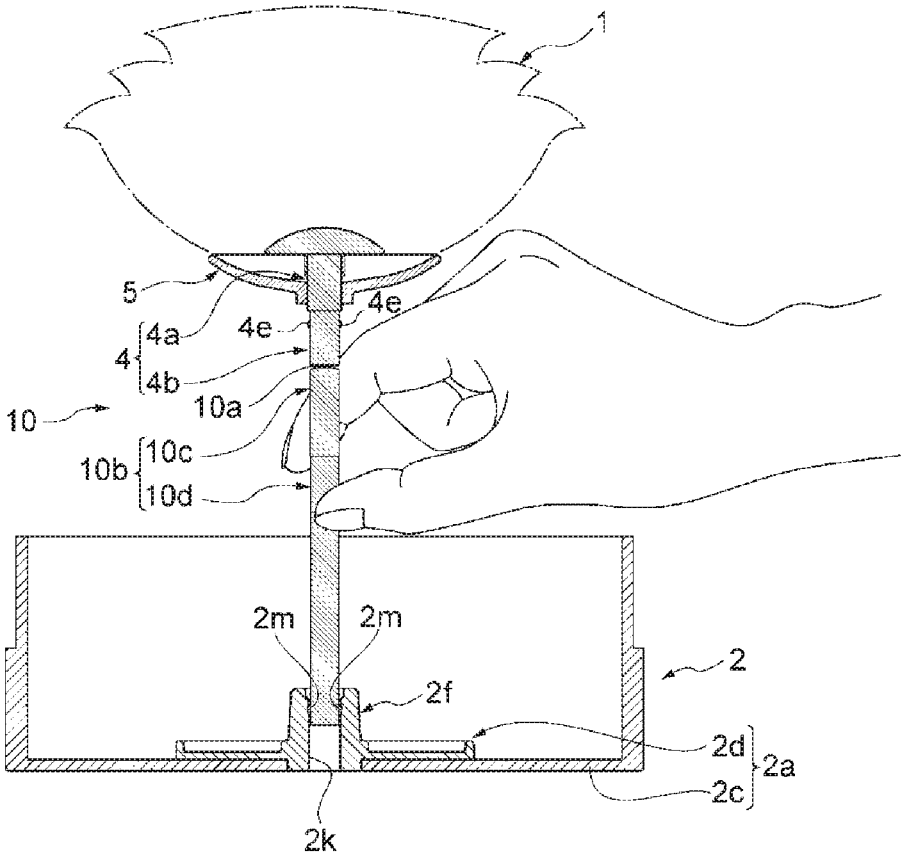
FIG. 8 is a diagram for describing a manufacturing method subsequent to FIG. 7.

First, as illustrated in FIG. 7, the extending portion 10*b* of the long shaft body 10 is grasped, and as illustrated in FIG. 8, the lower end portion of the second extending portion 10*d* is caused to enter the hole 2*k* from the upper side so that the lower end portion of the second extending portion 10*d* of the long shaft body 10 matches the hole 2*k* of the shaft body holder portion 2*d* of the bottom portion 2*a*.

Figure 9:
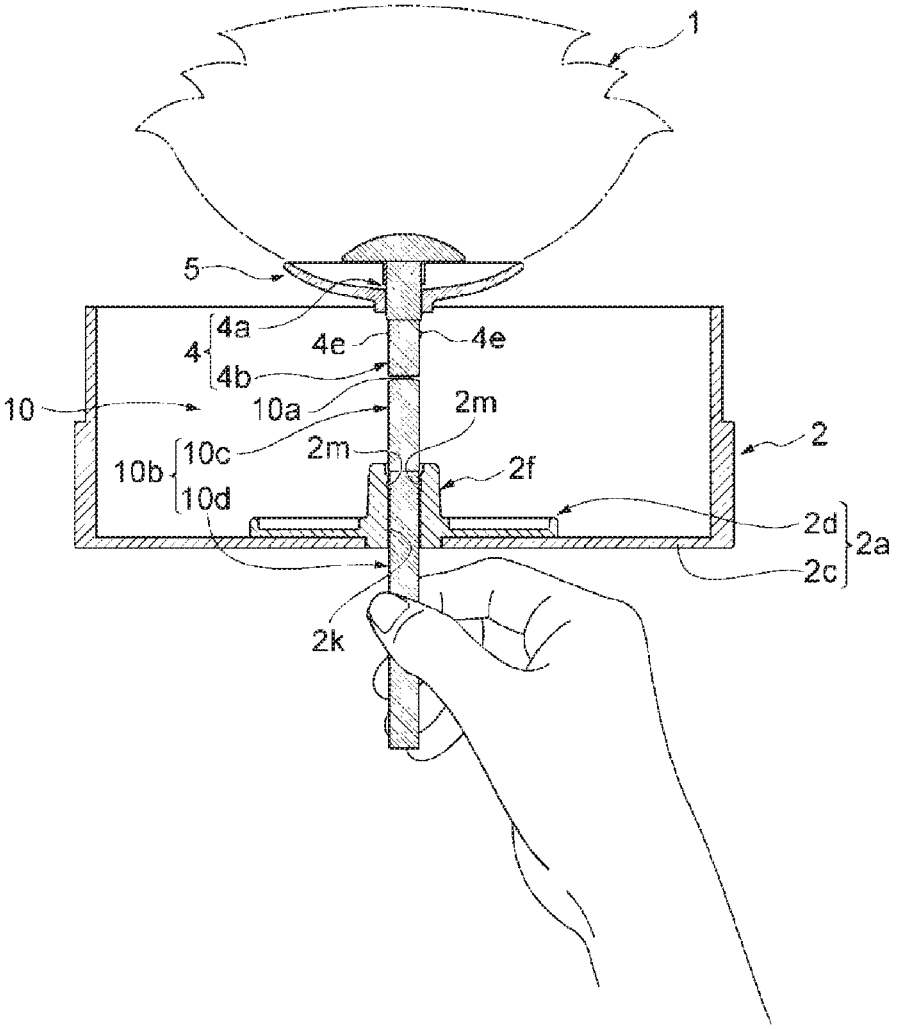
FIG. 9 is a diagram for describing the manufacturing method subsequent to FIG. 8.

At this time, since the second extending portion 10*d* of the long shaft body 10 has a columnar shape with a small diameter and circumferential matching is not necessary as compared with the hexagonal shape of the hole 2*k*, the second extending portion 10*d* can be easily inserted into the hole 2*k*. Further, the gripping of the long shaft body 10 is released. Then, as illustrated in FIG. 9, the long columnar second extending portion 10*d* protrudes outward from the bottom portion 2*a* (the base portion 2*c*) through the hole 2*k*, and the outer circumferential edge portion of the lower end surface of the first extending portion 10*c* (see FIG. 6) larger than the second extending portion 10*d* of the long shaft body 10 comes into contact with the upper portion of the hole 2*k*.

Figure 10:
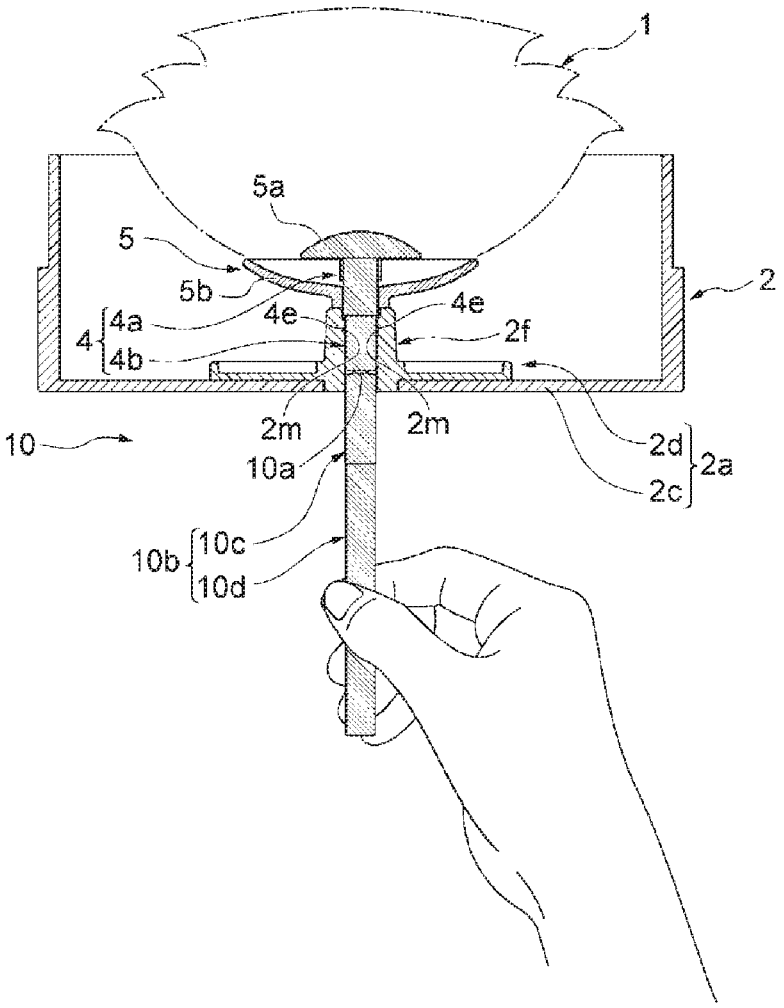
FIG. 10 is a diagram for describing the manufacturing method subsequent to FIG. 9.

In this state, by gripping the second extending portion 10*d* that is a portion, which protrudes outward from the bottom portion 2*a*, of the second extending portion 10*d* of the long shaft body 10 and by turning the second extending portion 10*d* slightly in the circumferential direction, it is possible to allow the hexagonal hole 2*k* and the hexagonal first extending portion 10*c* to easily match each other. Further, when the hexagonal first extending portion 10*c* matches the hexagonal hole 2*k*, the hexagonal first extending portion 10*c* is pulled downward as illustrated in FIG. 10.

Then, the lower end surface of the lower clamping portion 5*b* abuts against the upper end surface of the shaft body holder portion 2*d* (the shaft portion 2*f*), and the fitting convex portion 4*e* of the shaft body 4 is fitted into the fitting concave portion 2*m* of the shaft body holder portion 2*d*, the shaft body 4 is mounted to the shaft body holder portion 2*d*, and the thin portion 10*a* of the long shaft body 10 is located inside the hole 2*k*.

Figure 11:
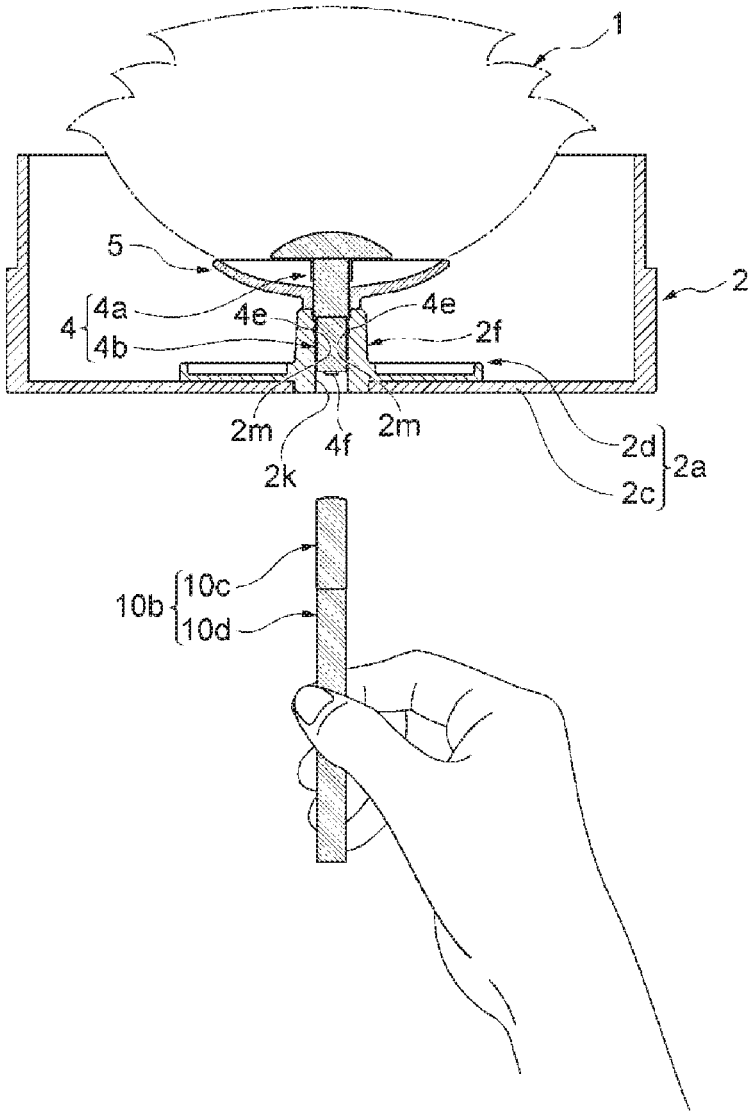
FIG. 11 is a diagram for describing the manufacturing method subsequent to FIG. 10.
Figure 12:
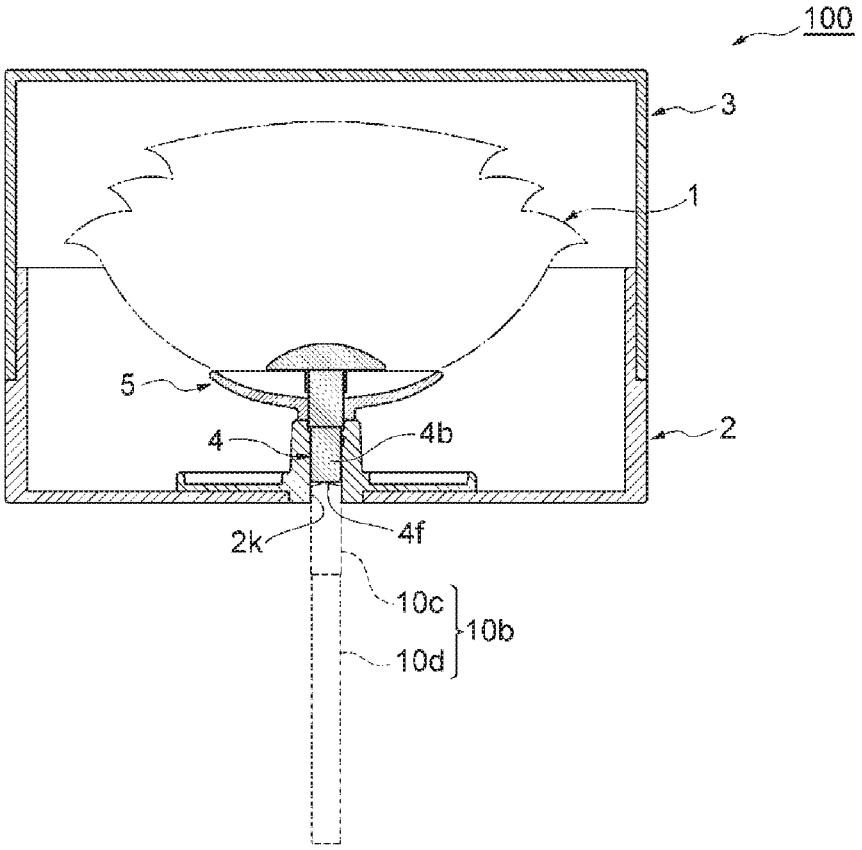
FIG. 12 is a diagram illustrating a state in which a long shaft body is shortened to a shaft body by the manufacturing method of FIGS. 7 to 11.

Next, a force is applied to the second extending portion 10*d* that is a portion, which protrudes outward from the bottom portion 2*a*, of the long shaft body 10, to cut the long shaft body 10 so that the shaft body 4 remains as illustrated in FIG. 11. Specifically, in the state illustrated in FIG. 10, a force is applied to the second extending portion 10*d*, which protrudes outward from the bottom portion 2*a*, of the long shaft body 10 in the horizontal direction (lateral direction) to cut the long shaft body 10 so as to be folded with the thin portion 10*a* as a boundary, or by applying a force in the axial direction and pulling the long shaft body 10, the long shaft body 10 is cut with the thin portion 10*a* as the boundary.

As illustrated in FIG. 12, the long shaft body 10 is shortened to the shaft body 4 by cutting, and the lower end surface 4*f* of the shaft body 4 is located inside the hole 2*k* and remains as a cut trace with the thin portion 10*a* of the long shaft body 10 as a boundary.

When the long shaft body 10 is cut by a tensile force, since the whole of the thin portion 10*a* is cleanly cut so as to be flush with the lower end surface of the shaft body 4, or the lower end surface of the shaft body 4 is hollowed, the lower end surface of the shaft body 4 is not necessarily limited to be thinner than the mounting shaft portion 4*b* located in the hole 2*k*.

Incidentally, when the shaft body 4 is bonded to the shaft body holder portion 2*d* (the bottom portion 2*a*), an adhesive may be applied in advance to the inner circumferential surface which forms the hole 2*k* or the portion of the shaft body 4 to be located in the hole 2*k*, and the shaft body 4 may pass through the hole.

The method for manufacturing the cosmetic material receptacle 100 includes the step of gripping the long shaft body 10 to enter the hole 2*k* of the bottom portion 2*a*; the step of gripping and pulling the extending portion 10*b* that is a portion, which protrudes outward from the bottom portion 2*a* through the hole 2*k*, in the long shaft body 10, and mounting the mounting shaft portion 4*b* that is a portion, which is located inside the hole 2*k*, in the long shaft body 10, to the bottom portion 2*a*; and the step of cutting the long shaft body 10 in the intermediate portion and providing the long shaft body 10 as a short shaft body 4 such that the lower end surface of the long shaft body 10 is flush with the outer surface of the bottom portion 2*a* or is located inside the hole 2*k*. Accordingly, it is possible to easily manufacture the cosmetic material receptacle 100 illustrated in FIG. 1, while preventing the peeling of the cosmetic material, without touching the artificial flower 1 to which the cosmetic material adheres, at the time of manufacturing.

In addition, since the long shaft body 10 is cut with the thin portion 10*a* provided in the middle of the long shaft body 10 as a boundary, cutting can be easily performed.

According to the cosmetic material receptacle 100 illustrated in FIG. 1 thus obtained, the artificial flower 1, which is formed into a three-dimensional shape and has a surface to which the cosmetic material adheres, is stored in the bottomed tubular receptacle 2, the shaft body 4 extending from the artificial flower 1 enters the hole 2*k* which is provided in the receptacle bottom portion 2*a* and communicates with the inside and outside of the receptacle, and the shaft body 4 is mounted to the bottom portion 2*a* in a state in which the lower end surface 4*f* thereof is flush with the outer surface of the bottom portion 2*a* or is located inside the hole. Accordingly, a user can allow the cosmetic material of the artificial flower 1, which does not move in the receptacle to easily adhere to the application body, without holding the artificial flower 1 to which the cosmetic material adheres, and without contaminating the hand. Further, since such a configuration is provided, the manufacturing method described above can be adopted and the cosmetic material receptacle can be easily manufactured.

Further, according to the cosmetic material receptacle 100 of this embodiment, since the lower end surface 4*f* of the shaft body 4 is thinner than the mounting shaft portion 4*b* located in the hole 2*k* above the lower end surface 4*f*, as described above, the long shaft body can be easily cut with the thin portion 10*a* as the boundary at the time of manufacturing.

Further, since the lower end surface 4*f* of the shaft body 4 is exposed to the outside, at the time of manufacturing, there is no need for a process of filling the hole 2*k* after the shaft body is cut, and the cosmetic material receptacle can be more easily manufactured.

Further, since the cross sections of the hole 2*k* and the shaft body 4 (mounting shaft portion 4*b*) have a hexagonal shape, the shaft body 4 can be reliably mounted so as not to rotate with respect to the bottom portion 2*a*. Further, the hole 2*k* and the shaft body 4 are not limited to the hexagonal shape, and if they have a non-circular shape, the same operation and effect can be obtained.

In addition, since the upper clamping portion 5*a* and the lower clamping portion 5*b* for clamping the artificial flower 1 from the upper and lower sides and mounting the artificial flower 1 to the shaft body 4 are included, it is possible to simply provide the configuration in which the shaft body 4 extends from the artificial flower 1.

Incidentally, a shielding portion for preventing the lower end surface 4*f* of the shaft body 4 from being seen from the outer surface side of the bottom portion 2*a* may be provided, such that the shaft body 4 and the hole 2*k* are made invisible from the outside to improve the appearance by such a shielding portion. As such a shielding portion, it is possible to adopt a filler which fills the hole 2*k* or a seal affixed to the outer surface of the bottom portion 2*a*.

Although the invention has been specifically described based on the embodiment, the invention is not limited to the above embodiment. For example, in the above embodiment, the artificial flower 1 is clamped between the upper clamping portion 5*a* and the lower clamping portion 5*b* and is mounted to the shaft body 4. However, the artificial flower 1 may be mounted to the shaft body by another method such as adhesion, and in short, the shaft body may be configured to extend from the artificial flower 1.

Further, in the above embodiment, the artificial flower 1 is particularly preferably used as a cosmetic material holding portion, but the cosmetic material holding portion may be other than the artificial flower, and the cosmetic material holding portion may have, for example, an animal or plant shape. Further, when the cosmetic material holding portion has a simple shape, the cosmetic material holding portion and the shaft body can be integrally formed.

EXPLANATIONS OF LETTERS OR NUMERALS

1: artificial flower (cosmetic material holding portion)
2: receptacle
2*a*: bottom portion
2*k*: hole
4: shaft body
4*b*: mounting shaft portion
4*f*: lower end surface of shaft body
5*a*: upper clamping portion
5*b*: lower clamping portion
10: long shaft body
10*a*: thin portion
10*b*: extending portion
100: cosmetic material receptacle

The invention claimed is:

1. A cosmetic material receptacle having a cosmetic material holding portion which is formed in a three-dimensional shape and has a surface to which a cosmetic material adheres, the cosmetic material receptacle comprising:

a bottomed tubular receptacle which stores the cosmetic material holding portion;

a hole which is provided at a bottom portion of the receptacle and communicates with the inside and outside of the receptacle; and a shaft body which extends from the cosmetic material holding portion and is mounted to the bottom portion in a state in which a lower end portion thereof enters the hole, wherein a lower end surface of the shaft body is flush with an outer surface of the bottom portion or is located inside the hole; and wherein cross sections of the hole and the shaft body have a non-circular shape.

2. The cosmetic material receptacle according to claim 1, wherein the lower end surface of the shaft body is thinner than a mounting shaft portion located in the hole above the lower end surface.

3. The cosmetic material receptacle according to claim 2, wherein the lower end surface of the shaft body is exposed to the outside.

4. The cosmetic material receptacle according to claim 3, further comprising:

an upper clamping portion and a lower clamping portion which clamp the cosmetic material holding portion from above and below and mount the cosmetic material holding portion to the shaft body.

5. The cosmetic material receptacle according to claim 2, further comprising:

a shielding portion which makes the lower end surface of the shaft body invisible from an outer surface side of the bottom portion.

6. The cosmetic material receptacle according to claim 5, further comprising:

an upper clamping portion and a lower clamping portion which clamp the cosmetic material holding portion from above and below and mount the cosmetic material holding portion to the shaft body.

7. The cosmetic material receptacle according to claim 2, further comprising:

an upper clamping portion and a lower clamping portion which clamp the cosmetic material holding portion from above and below and mount the cosmetic material holding portion to the shaft body.

8. The cosmetic material receptacle according to claim 1, wherein the lower end surface of the shaft body is exposed to the outside.

9. The cosmetic material receptacle according to claim 8, further comprising:

an upper clamping portion and a lower clamping portion which clamp the cosmetic material holding portion from above and below and mount the cosmetic material holding portion to the shaft body.

10. The cosmetic material receptacle according to claim 1, further comprising:

a shielding portion which makes the lower end surface of the shaft body invisible from an outer surface side of the bottom portion.

11. The cosmetic material receptacle according to claim 10, further comprising:

an upper clamping portion and a lower clamping portion which clamp the cosmetic material holding portion from above and below and mount the cosmetic material holding portion to the shaft body.

12. The cosmetic material receptacle according to claim 1, further comprising:

an upper clamping portion and a lower clamping portion which clamp the cosmetic material holding portion from above and below and mount the cosmetic material holding portion to the shaft body.

13. A method for manufacturing a cosmetic material receptacle having a cosmetic material holding portion which is formed in a three-dimensional shape and has a surface to which a cosmetic material adheres, and which comprises a bottomed tubular receptacle which stores the cosmetic material holding portion, a hole which is provided at a bottom portion of the receptacle and communicates with the inside and outside of the receptacle, and a shaft body which extends from the cosmetic material holding portion and is mounted to the bottom portion in a state in which a lower end portion thereof enters the hole, wherein a lower end surface of the shaft body is flush with an outer surface of the bottom portion or is located inside the hole, the method comprising:

gripping a long shaft body having a long length to cause the long shaft body to enter the hole of the bottom portion;

gripping and pulling a portion, which protrudes outward from the bottom portion through the hole, of the long shaft body, and mounting a portion, which is located inside the hole, of the long shaft body to the bottom portion; and cutting the long shaft body in an intermediate portion to form a shaft body from the long shaft body such that a lower end surface of the shaft body is flush with the outer surface of the bottom portion or is located inside the hole.

14. The method for manufacturing the cosmetic material receptacle according to claim 13, further comprising:

cutting the long shaft body with a thin portion provided in the middle of the long shaft body as a boundary.

* * * * *